US008860619B2

(12) United States Patent
Nysen

(10) Patent No.: US 8,860,619 B2
(45) Date of Patent: Oct. 14, 2014

(54) WIRELESS DEVICE AND MULTI-ANTENNA SYSTEM HAVING DUAL OPEN-SLOT RADIATORS

(71) Applicant: NETGEAR, Inc., San Jose, CA (US)

(72) Inventor: Paul A. Nysen, Carlsbad, CA (US)

(73) Assignee: NETGEAR, Inc., San Jose, CA (US)

( * ) Notice: Subject to any disclaimer, the term of this patent is extended or adjusted under 35 U.S.C. 154(b) by 215 days.

(21) Appl. No.: 13/623,734

(22) Filed: Sep. 20, 2012

(65) Prior Publication Data

US 2013/0076582 A1 Mar. 28, 2013

Related U.S. Application Data

(60) Provisional application No. 61/536,897, filed on Sep. 20, 2011.

(51) Int. Cl.

| | |
|---|---|
| ***H01Q 13/10*** | (2006.01) |
| ***H01Q 13/18*** | (2006.01) |
| ***H01Q 1/24*** | (2006.01) |
| ***H01Q 21/28*** | (2006.01) |

(52) U.S. Cl.

CPC ..... *H01Q 13/18* (2013.01); *H01Q 1/243* (2013.01); *H01Q 21/28* (2013.01)

USPC ..... 343/770; 343/702

(58) Field of Classification Search

CPC ..... H01Q 13/10; H01Q 13/18

USPC ..... 343/702, 770

See application file for complete search history.

(56) References Cited

U.S. PATENT DOCUMENTS

| | | | | |
|---|---|---|---|---|
| 5,831,583 | A * | 11/1998 | Lagerstedt et al. | 343/771 |
| 5,917,454 | A * | 6/1999 | Hill et al. | 343/769 |
| 2003/0222827 | A1 * | 12/2003 | Sung | 343/770 |
| 2009/0322636 | A1 * | 12/2009 | Brigham et al. | 343/770 |

* cited by examiner

*Primary Examiner* — Tan Ho

(74) *Attorney, Agent, or Firm* — Boyle Fredrickson, S.C.

(57) ABSTRACT

A multi-antenna system and wireless device comprising same are provided. The multi-antenna system comprises two open-slot antennas each coupled to its own resonant cavity. The two resonant cavities may be adjacent with common short circuit elements across their boundary. The short circuit elements may include apertures through which wires can be passed. The multi-antenna system may comprise two spaced-apart plates, each plate defining half of the first open-slot antenna, half of the second open-slot antenna, half of the first resonant cavity, and half of the second resonant cavity. The multi-antenna system can be fitted into a low-profile wireless device having a top face with a surface area about equal to or greater than that of the plates. A display such as a touch-screen may be fitted to the top face. The plate configuration may provide for a relatively large surface over which current can flow during antenna operation.

22 Claims, 6 Drawing Sheets

WIRELESS DEVICE AND MULTI-ANTENNA SYSTEM HAVING DUAL OPEN-SLOT RADIATORS

CROSS-REFERENCE TO RELATED APPLICATIONS

This application claims the benefit and priority of U.S. Provisional Patent Application No. 61/536,897, filed Sep. 20, 2011. The foregoing application is incorporated by reference herein in its entirety.

FIELD OF THE INVENTION

The present technology pertains in general to antenna systems and in particular to a multi-antenna system having dual open-slot radiators, and to wireless devices comprising same.

BACKGROUND

Compact antenna systems are desirable for reasons such as portability, cost, and ease of manufacture, and are particularly well-suited for mobile, wireless devices. Interest in compact antenna systems has been further stimulated by the use of higher radio frequencies, for example UHF and higher, which allow for antenna lengths significantly less than 10 centimeters.

However, factors such as decreasing a size of portable devices, decreasing power availability, and increased bandwidth and data rate requirements, make it increasingly challenging to provide for adequate antennas embedded in wireless devices. Approaches such as antenna diversity and multi-input multi-output (MIMO) communications may be used to provide performance improvements in many situations; however, it is again difficult to provide multiple antennas with adequate isolation and/or envelope correlation coefficient in physically small wireless devices.

Various mobile wireless devices are available which include multiple antennas. However, such antennas generally come with limitations, and it remains difficult to provide an antenna or multi-antenna system which exhibits acceptable performance for a given application, for example as measured by factors such as gain, efficiency, bandwidth, q-factor, antenna isolation, and envelope correlation coefficient. In addition, it is desirable to provide antennas which satisfy regulatory requirements with regard to specific absorption rates (SAR), and which operate adequately when housed in close proximity with other electronic components of the mobile wireless device.

Therefore there is a need for a compact wireless device and multi-antenna system that is not subject to one or more limitations of the prior art.

This background information is provided for the purpose of making known information believed by the applicant to be of possible relevance to the present technology. No admission is necessarily intended, nor should be construed, that any of the preceding information constitutes prior art against the present technology.

SUMMARY OF THE INVENTION

An object of the present technology is to provide a multi-antenna system having dual open-slot radiators, and to a wireless device comprising same. In accordance with an aspect of the present technology, there is provided a multi-antenna system comprising: a first open-slot antenna comprising first and second conductive elements defining a first region between opposing faces thereof; a second open-slot antenna comprising third and fourth conductive elements defining a second region between opposing faces thereof; a first resonant cavity operatively coupled to the first open-slot antenna and disposed between the first open-slot antenna and the second open-slot antenna, the first resonant cavity comprising fifth and sixth conductive elements defining a third region between opposing faces thereof, the third region connected with the first region; a second resonant cavity operatively coupled to the second open-slot antenna and disposed between the first open-slot antenna and the second open-slot antenna, the second resonant cavity comprising seventh and eighth conductive elements defining a fourth region between opposing faces thereof, the fourth region in communication with the second region; and one or more conductive shorts, each of the one or more conductive shorts configured to electrically couple the fifth conductive element to the sixth conductive element, and to electrically couple the seventh conductive element to the eighth conductive element.

In accordance with another aspect of the present technology, there is provided a wireless device comprising a multi-antenna system, the multi-antenna system comprising: a first open-slot antenna comprising first and second conductive elements defining a first region between opposing faces thereof; a second open-slot antenna comprising third and fourth conductive elements defining a second region between opposing faces thereof; a first resonant cavity operatively coupled to the first open-slot antenna and disposed between the first open-slot antenna and the second open-slot antenna, the first resonant cavity comprising fifth and sixth conductive elements defining a third region between opposing faces thereof, the third region connected with the first region; a second resonant cavity operatively coupled to the second open-slot antenna and disposed between the first open-slot antenna and the second open-slot antenna, the second resonant cavity comprising seventh and eighth conductive elements defining a fourth region between opposing faces thereof, the fourth region in communication with the second region; and one or more conductive shorts, each of the one or more conductive shorts configured to electrically couple the fifth conductive element to the sixth conductive element, and to electrically couple the seventh conductive element to the eighth conductive element.

In accordance with an aspect of the present technology, there is provided a multi-antenna system comprising first and second spaced-apart conductive plates configured to define: a first open-slot antenna; a second open-slot antenna; a first resonant cavity adjacent and operatively coupled to the first open-slot antenna and disposed between the first open-slot antenna and the second open-slot antenna; and a second resonant cavity adjacent and operatively coupled to the second open-slot antenna and disposed between the first resonant cavity and the second open-slot antenna; the multi-antenna system further comprising one or more conductive shorts configured to electrically couple the first conductive plate to the second conductive plate, the one or more conductive shorts located along a boundary between the first resonant cavity and the second resonant cavity.

BRIEF DESCRIPTION OF THE FIGURES

These and other features of the technology will become more apparent in the following detailed description in which reference is made to the appended drawings.

DETAILED DESCRIPTION OF THE INVENTION

Definitions

Figure 1A:
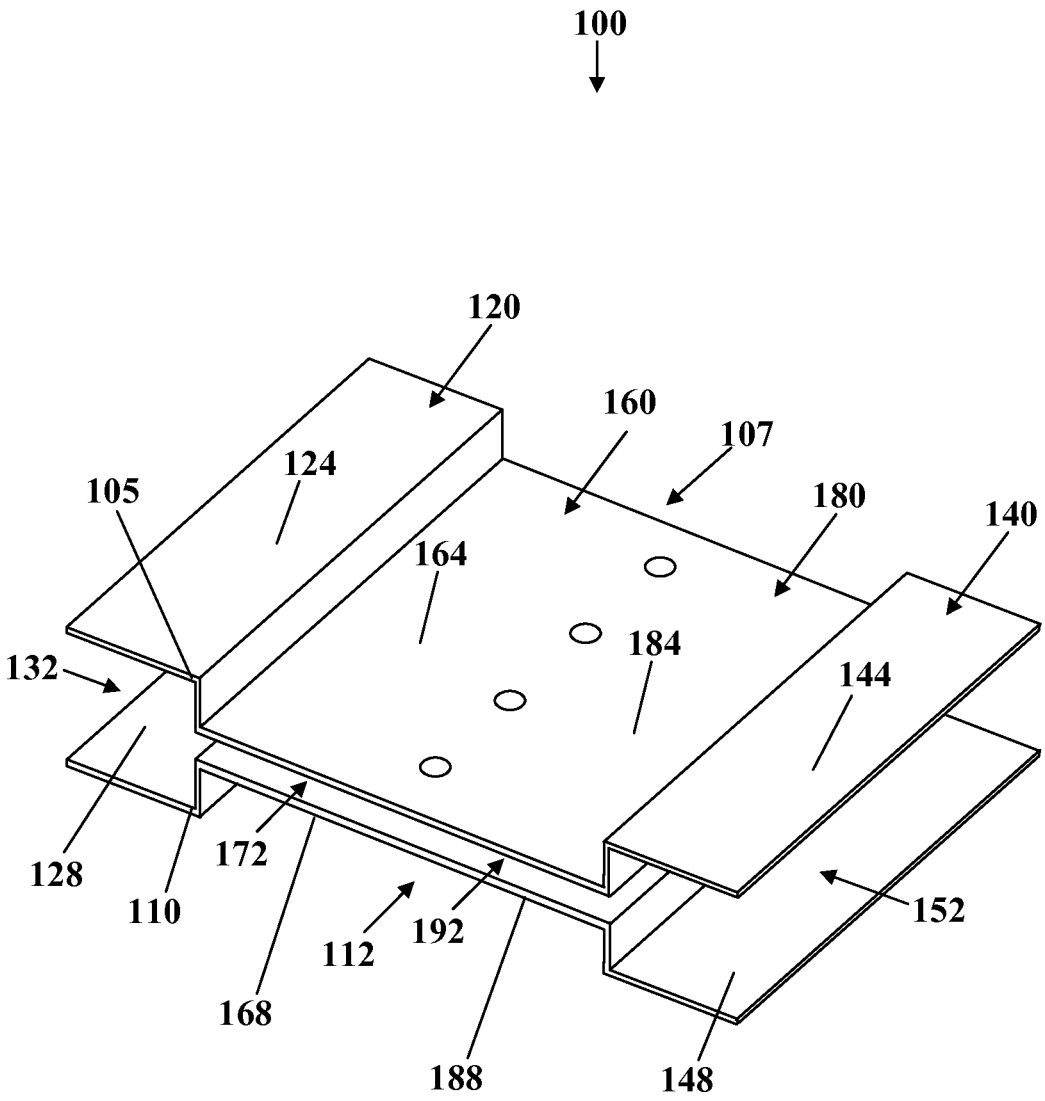
FIG. 1A illustrates a perspective view of a multi-antenna system provided in accordance with an embodiment of the present technology.

The term "antenna" refers to a system of conductive elements, which radiate an electromagnetic field in response to an appropriate alternating voltage and/or current applied to one or more elements of the system, or which produce an alternating voltage and/or current when placed in an appropriate electromagnetic field, or both.

The term "multi-antenna system" refers to a system of plural antennas which can be used cooperatively for communication. Multi-antenna systems may be used to facilitate antenna diversity, MIMO communications, and the like, as would be readily understood by a worker skilled in the art. In antenna diversity, it is typically desirable that different antennas experience different interference environments, for example through spatial diversity, pattern diversity, polarization diversity, or the like.

The term "antenna radiation pattern" is defined as a geometric representation of the relative electric field strength as emitted by a transmitting antenna at different spatial locations. For example, a radiation pattern can be represented pictorially as one or more two-dimensional cross sections of the three-dimensional radiation pattern. Because of the principle of reciprocity, it is known that an antenna has the same radiation pattern when used as a receiving antenna as it does when used as a transmitting antenna. Therefore, the term radiation pattern is understood herein to also apply to a receiving antenna, where it is representative of the relative amount of electromagnetic coupling between the receiving antenna and an electric field at different spatial locations.

The term "polarization", as it pertain to antennas, is defined herein as a spatial orientation of the electric field produced by a transmitting antenna, or alternatively the spatial orientation of electrical and magnetic fields causing substantially maximal resonance of a receiving antenna. For example, in the absence of reflective surfaces, a simple monopole or dipole transmitting antenna radiates an electric field which is oriented parallel to the radiating conductive elements of the antenna.

As used herein, the term "slot antenna" refers to an antenna comprising one or more conductive elements which define a slot therein or there between. The slot may be generally described as an aperture or cavity which has at least one face or portion which is not bounded by the antenna's conductive elements. The slot may be substantially filled with air or with another dielectric or insulating material.

As would be readily understood by a worker skilled in the art, a slot may have a closed perimeter, for example in the case of a slot having a generally O-shaped cross section, or an open perimeter, for example in the case of a slot having a generally C-shaped cross section. The term "open-slot antenna" is used herein to refer to the open perimeter type. For example, a notch antenna may be regarded as a type of open-slot antenna.

As used herein, the term "about" refers to a +/−20% variation from the nominal value. It is to be understood that such a variation is always included in a given value provided herein, whether or not it is specifically referred to.

Unless defined otherwise, all technical and scientific terms used herein have the same meaning as commonly understood by one of ordinary skill in the art to which this technology belongs.

In accordance with an aspect of the present technology, there is provided a low-profile multi-antenna system comprising two substantially linearly polarized antennas with open-sided slot radiators. The multi-antenna system is generally formed from two parallel conductive plates and the antennas are generally polarized in a direction which is normal to a main surface of the conductive plates. Each slot cavity is backed with a shorted cavity resonator. The two backing cavities are shorted together using a shared set of conductive shorts. In embodiments of the present technology, this shorting configuration may provide for a continuous ground plane between the two antenna systems. This can be particularly advantageous for circuit layout, full sized displays/touch screens and batteries. In embodiments of the present technology, to operate effectively, the two antenna systems do not require electrical connection at this common interface. Furthermore, in embodiments of the present technology, connecting the two antenna systems does not alter the antenna performance significantly. Channels through the conductive shorts provide a means for passing cables through the multi-antenna system to connect wireless device components on either side. The two antenna feeds are across the open gap between the two conductive plates, each antenna feed located near the boundary between the slot cavity and the backing cavity.

In accordance with an aspect of the present technology there is provided a multi-antenna system comprising a first open-slot antenna, a second open-slot antenna, a first resonant cavity, and a second resonant cavity. The first open-slot antenna comprises first and second spaced-apart conductive elements. Opposing faces of the first and second conductive elements are disposed to define a first slot region there between. Similarly, the second open-slot antenna comprises third and fourth spaced-apart conductive elements, with opposing faces of the third and fourth conductive elements disposed to define a second slot region there between. The first resonant cavity is operatively coupled to the first open-slot antenna and disposed between the first open-slot antenna and the second open-slot antenna. The first resonant cavity comprises fifth and sixth spaced-apart conductive elements. The fifth and sixth conductive elements define a third region between opposing faces thereof, with the third region connected with the first region. Similarly, the second resonant cavity is operatively coupled to the second open-slot antenna and disposed between the first resonant cavity and the second open-slot antenna. The second resonant cavity comprises seventh and eighth spaced-apart conductive elements. The seventh and eighth conductive elements define a fourth region between opposing faces thereof, with the fourth region connected with the second region associated with the second open-slot antenna. The multi-antenna system further comprises one or more conductive shorts which provide a common backing for the resonant cavities. To this end, each of the one or more conductive shorts is configured to electrically couple the fifth conductive element to the sixth conductive element, and to also electrically couple the seventh conductive element to the eighth conductive element. In embodiments of the present technology, the RF shorting between the two slot systems may significantly provide for a high front to back ratio thus in this way the two antenna systems are sufficiently isolated to ensure their orthogonality and a very low ECC (Envelope Correlation Coefficient).

In embodiments of the present technology, major portions of the antennas and resonant cavities may be generally and integrally formed from two spaced-apart conductive plates. For example, the first conductive element, the third conductive element, the fifth conductive element and the seventh conductive element may be integral to a first substantially contiguous conductive plate, and the second conductive element, the fourth conductive element, the sixth conductive element, and the eighth conductive element may be integral to a second substantially contiguous conductive plate.

In a further embodiment, a channel is formed passing through the first conductive plate, the second conductive plate, and an interior portion of one of the conductive shorts. In some embodiments, multiple channels may be formed through multiple conductive shorts. The conductive shorts may be spaced apart by a predetermined amount, for example so as to allow air flow between the conductive plates being shorted. In various embodiments, the spacing distance of the shorts may be sufficiently small that the spaced-apart shorts restrict or significantly attenuate propagation of radio signals, at the antenna operating frequencies, past the line of conductive shorts. Conductors, fibre optics, or both, may be passed through the channels in order to operatively couple components on opposite sides of the multi-antenna system. This is particularly advantageous when the multi-antenna system is embedded within a wireless device of about the same length and width, since in this case it would be difficult to route cabling around the multi-antenna system due to lack of space.

In embodiments of the present technology, the components of the multi-antenna system are formed from two substantially thin conductive plates which face each other. For example, in one such embodiment, each of the first, second, third, fourth, fifth, sixth, seventh and eighth conductive elements have predetermined thicknesses, the opposing faces of each of the first, second, third, fourth, fifth, sixth, seventh and eighth conductive elements have predetermined lengths and widths, and each of said thicknesses is less than each of the corresponding lengths and widths.

In embodiments of the present technology, the first and second conductive elements are separated by a first predetermined distance, and the fifth and sixth conductive elements are separated by a second predetermined distance less than the first predetermined distance. Thus, the open-slot antennas may comprise slots which are wider, as measured from conductive element to conductive element, than the slots of their corresponding resonant cavities. The multi-antenna system may be correspondingly formed from two separate conductive plates which are bent or shaped so as to be closer together in the vicinities of the resonant cavities than in the vicinities of the open-slot antennas.

In accordance with yet another aspect of the present technology there is provided a multi-antenna system comprising first and second spaced-apart conductive plates. The plates are configured to define a first open-slot antenna, a second open-slot antenna; a first resonant cavity, and a second resonant cavity. The first resonant cavity is adjacent and operatively coupled to the first open-slot antenna, and is disposed between the first open-slot antenna and the second open-slot antenna. The second resonant cavity is adjacent and operatively coupled to the second open-slot antenna and disposed between the first resonant cavity and the second open-slot antenna. The multi-antenna system further comprises one or more conductive shorts configured to electrically couple the first conductive plate to the second conductive plate. The one or more conductive shorts are located along a boundary between the first resonant cavity and the second resonant cavity. In some embodiments, the first open-slot antenna comprises first and second conductive elements defining a region between opposing faces thereof. The region comprises at least one non-conductive face, that is, the region is not completely enclosed by the conductive elements. The non-conductive face may be an open face and/or air gap. The first conductive element of the first antenna is formed of a portion of the first conductive plate, and the second conductive element of the first antenna formed of a portion of the second conductive plate.

In accordance with embodiments of the present technology, additional shorting posts and or tuning posts may be placed within either one or the other of the slot and or resonator volumes to provide for multi-resonances. This may permit either broadbanding or multiple bands for the antenna systems, as is practiced in the art of cavity filters.

In accordance with another aspect of the present technology, there is provided a wireless device comprising a multi-antenna system as described herein. In some embodiments, this construction can provide two large pockets, one above and one below wherein electronics and or batteries may be placed. This may also provide for a full LCD panel display/touch screen that may cover the entire top face from edge to edge. While the slot height is typically illustrated herein as being significantly higher than the resonator height, this is not a limiting feature. For example, the slot height may also be the same as the resonator height. The wireless device may be a wireless hotspot, cell phone, Smartphone, home networking device, wireless-enabled media player, or other wireless-enabled wireless device, as would be readily understood by a worker skilled in the art. The wireless device may comprise a user interface, such as a LCD display, touch screen, or the like, along with a battery, processor, memory, digital signal processing components, radiofrequency (RF) electronics, and the like. The wireless device may be configured to utilize its at least two antennas to implement one or more MIMO approaches for wireless communication. For example, the wireless device may be a wireless hotspot or other device configured for MIMO communication in accordance with an IEEE 802.11n protocol, LTE protocol, IEEE 802.16 protocol, or other wireless communication protocol. The wireless device may be additionally or alternatively configured to take advantage of other antenna diversity techniques. Various components, configurations, and functionalities may be embodied by the wireless device, as would be readily understood by a worker skilled in the art.

In a further embodiment, the wireless device comprises a first set of components and a second set of components, with the multi-antenna system disposed between the first set of components and the second set of components. For example, the first set of components may include user interface electronics, and the second set of components may include a battery for powering the user interface electronics. The multi-antenna system comprises at least one channel passing from one side to the other, each channel passing through the interior portion of a conductive short. The first set of components and the second set of components are operatively coupled via the channel, for example by power cables, signal cables, fibre optics, or the like, or a combination thereof. In some embodiments, the channels are substantially separated from the interior cavities of the multi-antenna system, since they pass through an interior portion of the conductive short which does not communicate with those interior cavities. In some embodiments, portions of transmission lines for connection to the multi-antenna system may pass through the channels. In embodiments of the present technology, the conductive shorts are further configured to mechanically hold together the multi-antenna system, and hence the wireless device.

The multi-antenna system comprises a pair of the antennas. In some embodiments the antennas are generally oriented as mirror images of each other with respect to a predetermined axis of symmetry. The multi-antenna system may be used as a diversity antenna system, MIMO antenna system, or the like.

In embodiments of the present technology, the conductive plates of the multi-antenna system, which make up the open-slot antennas and resonant cavities, have a substantially large conductive surface area in comparison to the surface area of the mobile device. This contributes somewhat to the antenna performance, and may also aid in avoiding highly concentrated currents in the antenna. This in turn may reduce problems such as localized regions of more intense RF radiation, which may result in more favourable SAR measurements.

For multi-antenna systems, an often significant consideration is isolation between antennas. For example, greater antenna isolation or lower envelope correlation coefficient suggests a greater probability that one antenna will experience an adequate radio environment even if another does not. As would be readily understood by a worker skilled in the art, radio environments may degrade due to excessive noise, signal fading such as multipath fading, and the like.

In embodiments of the present technology, each of the pair of antennas is substantially isolated from the other, for example as measured by envelope correlation coefficient characteristics. For example, each antenna of a pair primarily radiates and receives in opposite directions from the other. In typical signal propagation environments this means that when both of the antennas of the pair receive signals from the same transmitter, the combinations of delayed signal components and their amplitudes received by each antenna will typically not be similar. A benefit of this configuration is that when one antenna of a pair is not receiving a good signal, the other antenna of the pair typically is. In addition, for example in (multiple-input multiple-output) MIMO these separate signal paths can be used as a means to increase throughput of data, which is enabled by treating the two signal paths as separate transmission media, which is known in the art as spatial diversity. As a "Hotspot" laid flat on a horizontal surface the radiation pattern will be substantially vertically polarised with opposing cardioid beam patterns for the two antennas in the horizontal plane. This is well suited to typical cellular systems, even when indoors.

In various embodiments, the radiation pattern comprises beams directed outward from the open slots. The radiation pattern may thus be substantially confined to a region which excludes areas above, below and behind the open slot radiators, for example above and below the first and second conductive plates forming the antennas. In this manner, at least some RF isolation may be achieved between the antennas and electronics placed above and/or below the first and second conductive plates. Such isolation may reduce or substantially eliminate the need for separate electronics shielding, for example.

The technology will now be described with reference to specific examples. It will be understood that the following examples are intended to describe embodiments of the technology and are not intended to limit the technology in any way.

Figure 1B:
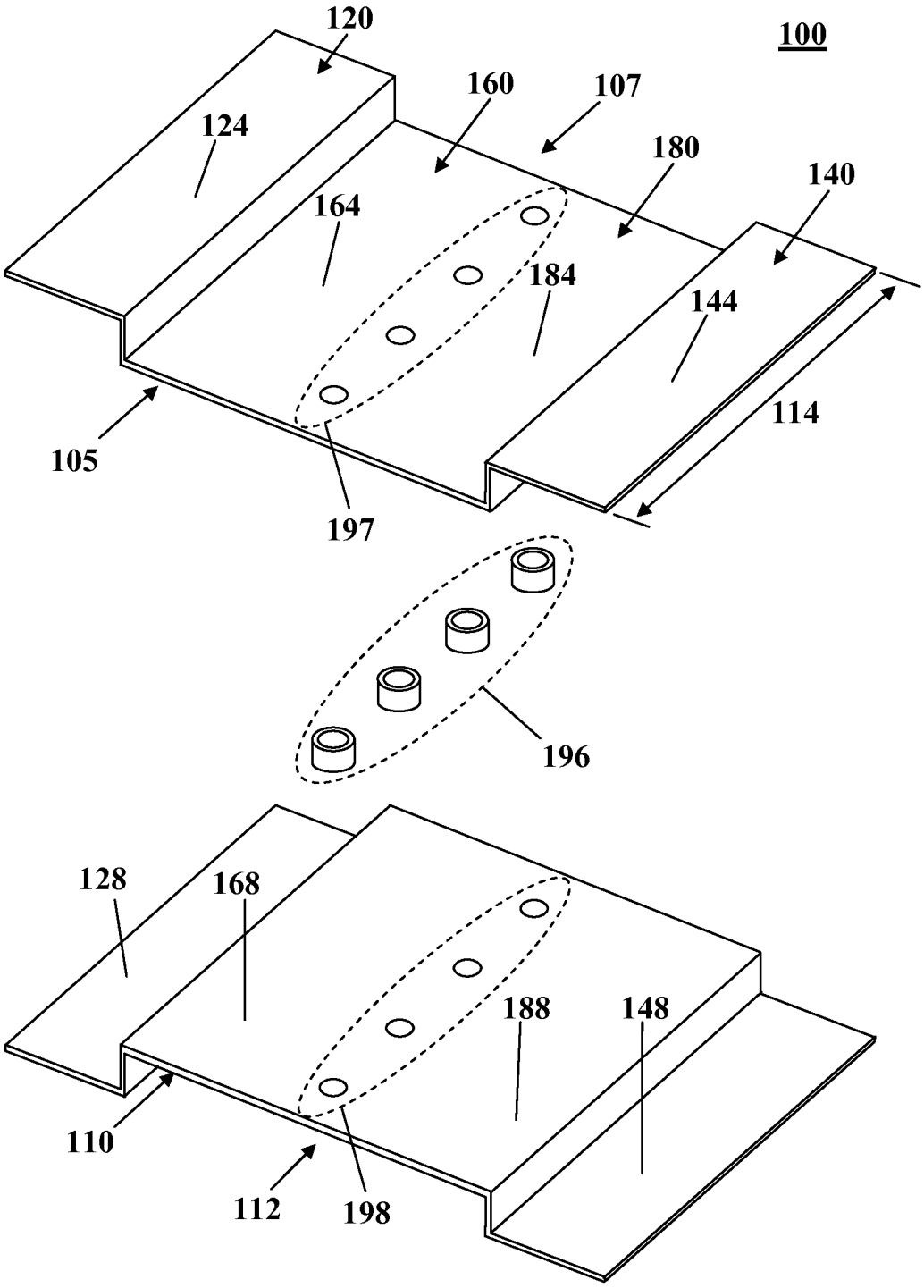
FIG. 1B illustrates an exploded view of the multi-antenna system of FIG. 1A.
Figure 1C:
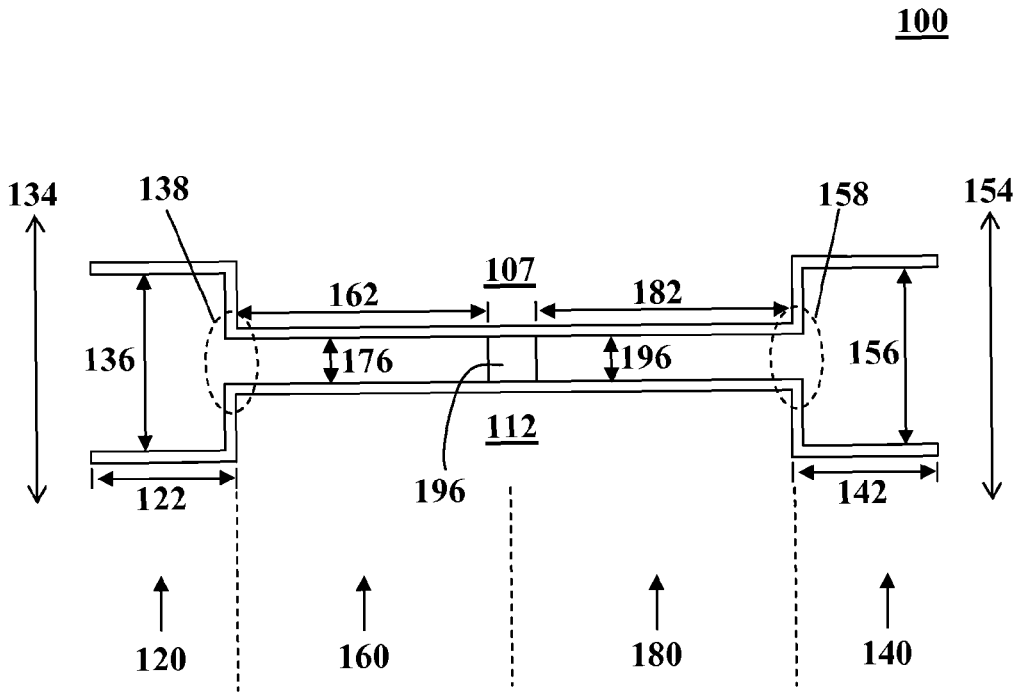
FIG. 1C illustrates an elevation view of the multi-antenna system of FIG. 1A.

FIGS. 1A, 1B and 1C illustrate perspective, exploded, and elevation views, respectively, of a multi-antenna system 100 provided in accordance with an embodiment of the present technology. The system 100 comprises a first shaped conductive plate 105 spaced apart from a second shaped conductive plate 110. The conductive plates 105 and 110 are co-configured to form a first open-slot antenna 120, a second open-slot antenna 140, a first resonant cavity 160, and a second resonant cavity 180. The first resonant cavity 160 is situated adjacent to and between the first open-slot antenna 120 and the second resonant cavity 180, and the second resonant cavity 180 is situated adjacent to and between the second open-slot antenna 140 and the first resonant cavity 160. The first and second open-slot antennas have a generally C-shaped cross section, as shown in FIG. 1C.

The first open-slot antenna 120 comprises a first conductive element 124, a second conductive element 128, and a gap 132 between the first and second conductive elements. In the illustrated embodiment, the first conductive element 124 is formed from an end portion of the first conductive plate 105 and the second conductive element 128 is formed from a corresponding end portion of the second conductive plate 110. The first open-slot antenna has a polarization generally oriented in the direction 134, as illustrated in FIG. 1C.

The second open-slot antenna 140 comprises a third conductive element 144, a fourth conductive element 148, and a gap 152 between the third and fourth conductive elements. In the illustrated embodiment, the third and fourth conductive elements are formed from end portions of the first and second conductive plates, opposite from the first and second conductive elements 124 and 128. The second open-slot antenna has a polarization generally oriented in the direction 154.

The first resonant cavity 160 comprises a fifth conductive element 164 and a sixth conductive element 168, and a gap 172 between the fifth and sixth conductive elements. The second resonant cavity 180 comprises a seventh conductive element 184 and an eighth conductive element 188, and a gap 192 between the seventh and eighth conductive elements. In the illustrated embodiment, the fifth conductive element 164 is formed from a portion of the first conductive plate 105 between the first and seventh conductive elements, and the sixth conductive element 168 is formed from a corresponding portion of the second conductive plate 110 between the second and eighth conductive elements. The gap 172 is in communication with the gap 132 of the first antenna. In addition, for the illustrated embodiment, the seventh conductive element 184 is formed from a portion of the first conductive plate 105 between the third and fifth conductive elements, and the eighth conductive element 188 is formed from a corresponding portion of the second conductive plate 110 between the fourth and sixth conductive elements. The gap 192 is in communication with the gap 152 of the second antenna.

As illustrated, the gaps 172 and 192 of the resonant cavities are narrower than the gaps 132 and 152 of the antennas. Each of the first and second conductive plates 105 and 110 may be shaped to provide a narrowed section in the region of the resonant cavities. In conjunction with a substantially uniform plate thickness, this narrowing may also create a cavity 107 adjacent to the first plate 105 and a cavity 112 adjacent to the second plate 110, the cavities being on opposite sides of the plates to the resonant cavity gaps. The cavities 107 and 112 may be utilized to house components of a wireless device operatively coupled to the multi-antenna system, thereby making efficient use of space and facilitating a low profile of the wireless device.

The antennas 120 and 140 of the multi-antenna system 100 are operatively coupled to their respective transmission lines at antenna feed points in the regions 138 and 158, respectively, as illustrated in FIG. 1C. For example, for the first antenna 120, a coaxial, microstrip, or stripline transmission line comprising a pair of conductors may be routed to the region 138, at which point one conductor of the transmission line may be coupled to the conductive body 124, and the other coupled to the conductive body 128, thereby providing an antenna feed across the gap 132 at or near the location where it narrows into the gap 172. The second antenna 140 may be similarly operatively coupled to its own transmission line.

Various dimensions of the multi-antenna system, such as the illustrated widths 136, 156, 176 and 196 of gaps 132, 152, 172 and 192, the lengths 122, 142 of the antennas 120 and 140, the lengths 162, 182 of the resonant cavities 160 and 180, and the depth 114 of the multi-antenna system, may be configured to facilitate antenna operation in a desired frequency range, to facilitate multi-antenna compactness, or both. Variation in these dimensions may affect properties such as antenna resonant frequency, antenna bandwidth, antenna gain, antenna radiation pattern, and the like, as would be readily understood by a worker skilled in the art.

As illustrated in FIG. 1B, the multi-antenna system 100 further comprises a plurality of conductive shorts 196, which electrically couple the first plate 105 to the second plate 110 at a location between the first resonant cavity 160 and the second resonant cavity 180. The conductive shorts facilitate electrical termination and separation of the resonant cavities. As illustrated, plural, spaced-apart shorts may be used, which may provide for adequate electrical termination and separation provided the spacing between shorts is sufficiently small. Alternatively, a single, contiguous short may be provided which spans substantially the entire depth 114 of the multi-antenna system. However, providing a separation between shorts facilitates a reduction in the amount of material used, and facilitates airflow between the conductive plates. As also illustrated, the conductive shorts 196 comprise a hollow center, a plurality of spaced-apart apertures 197 are provided in the first conductive plate 105 and a plurality of spaced-apart apertures 198 are provided in the second conductive plate 110. The conductive shorts 196, the apertures 197, and the apertures 198 are aligned so as to provide a plurality of channels communicating with cavities 107 and 112. This allows cabling such as electrical power and signal wires to be passed through from one side of the multi-antenna system to the other, while maintaining integrity of the multi-antenna system as a pair of substantially uniform conductive plates.

Although the multi-antenna system 100 of the illustrated example is depicted with a uniform depth 114, symmetrical first and second antennas, symmetrical first and second resonant cavities, and a substantially planar configuration, the multi-antenna system as described herein is not limited to these properties. For example, the multi-antenna system can be varied from the substantially rectangular shape depicted, to provide a varying depth 114, non-rectangular shaped open-slot antennas, for example triangular, circular, or polygonal shape, or the like. As another example the gap width may be varied substantially continuously or non-continuously. As yet another example, the entire multi-antenna system may be folded, bent or curved along one or more axes, so that the conductive bodies of the different antennas are bent, non-parallel, or a combination thereof. As would be readily understood by a worker skilled in the art, changes to the shape of the multi-antenna system may be accompanied by commensurate changes in functionality.

In one embodiment, the multi-antenna system has the following approximate dimensions. The antenna conductive plates are about 17.2 mm long by 50.6 mm deep, separated by a gap width of about 12.9 mm. The resonant cavity conductive plates are about 25.8 mm long by 50.6 mm deep, separated by a gap width of about 1.9 mm. This provides for a relatively compact multi-antenna system which may be fitted into a correspondingly compact wireless device, such as a wireless MIMO hotspot.

In embodiments of the present technology, each antenna may be operated at one or more frequencies in the range from 1.8 GHz to 2.7 GHz. Thus, for example, the antennas may be used for communication via systems or protocols such as PCS, WiMAX™, WiFi™, or the like. In some embodiments, the antennas and associated wireless device may be configured for operation using one wireless protocol or plural wireless protocols. As would be readily understood, embodiments of the present technology may be configured for operation in other frequency ranges. In some embodiments, the dimensions of the antenna system may be adjusted at least in part to facilitate operation in a desired frequency range, with a desired bandwidth, or both.

In embodiments of the present technology, the antennas have a polarization which is substantially perpendicular to the conductive plates of the multi-antenna system, for example as illustrated in FIG. 1C. Thus, the antennas are vertically polarized when the multi-antenna system is oriented with its two conductive plates substantially horizontal. A low-profile wireless device comprising the multi-antenna system oriented horizontally will then have a substantially vertical polarization.

In embodiments of the present technology, substantially all parts of the multi-antenna system comprise conductive surfaces, but the outsides of these surfaces are substantially electrically neutral during operation. As such, there may be no significant external currents, namely currents present on the outside surface of the multi-antenna system, or the external currents may be maintained below a predetermined threshold during operation. Typically, the charge generated across the open slot requires the return currents to be substantially internal to the slot and resonator surfaces. This reduction of external currents conveniently causes the SAR to decrease substantially.

In some embodiments, this configuration may lead to a reduction in SAR and/or high radiated field strength "hotspots" around the antenna. Furthermore, in some embodiments this configuration may result in a multi-antenna system, the operation of which is substantially unimpeded or unaffected by placement on a conductive surface. Furthermore, in some embodiments this configuration may result in a multi-antenna system, the operation of which is substantially unimpeded or unaffected by proximity to other electronics of the mobile device. Thus, for example, the whole of the top of the mobile device may be made into a display in close proximity to the multi-antenna system, while maintaining antenna performance.

In embodiments of the technology, the open gaps of the open-slot antennas facilitate heat isolation, convective cooling, or both, of one or more components, such as the multi-antenna system, wireless device electronics, or the like. In some embodiments, the open-slots of the antennas are at least partially exposed, forming a part of the exterior of the wireless device. The open slots thereby form a channel for ambient air to pass through, thereby facilitating cooling. In some embodiments, the channel passes through from one open slot to the other. The host wireless device may also comprise openings which facilitate air flow through the channel. Heat sinks may be appropriately placed so that electronics may dissipate heat adjacent to the channels for further dissipation via flowing air. Optionally, one or more fans may be provided which force air through the open slots.

In some embodiments, non-conductive structural elements, such as columns, may be provided across the otherwise open slots for structural integrity of the wireless device. In some embodiments, the multi-antenna system may be contained in a non-conductive housing, which may optionally have slots or other openings configured to allow air to flow through the open slots. For example, the housing may be configured as a thin plastic outer casing which comprises one or more ribs configured to support the outer edges of the slots. Alternatively, non-conductive material such as dielectric material may fill a substantial portion of the open slots and be bonded to the multi-antenna system conductive components to provide structural integrity, if convective cooling is not required. In embodiments of the present technology, a low-loss material may be used which may result in improved performance.

Figure 2A:
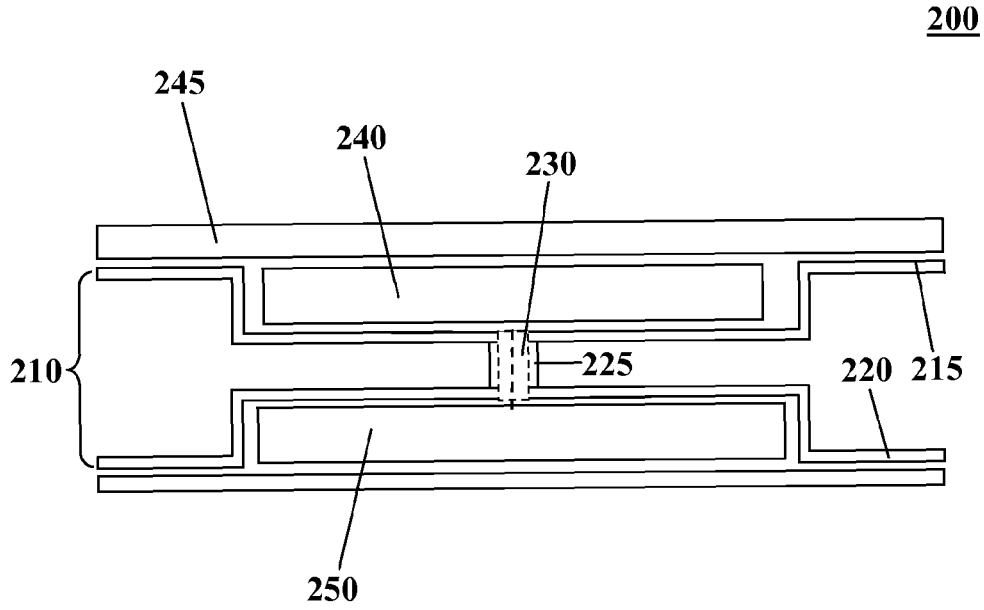
FIG. 2A illustrates an elevation view of a portion of a wireless device comprising a multi-antenna system, provided in accordance with an embodiment of the present technology.
Figure 2B:
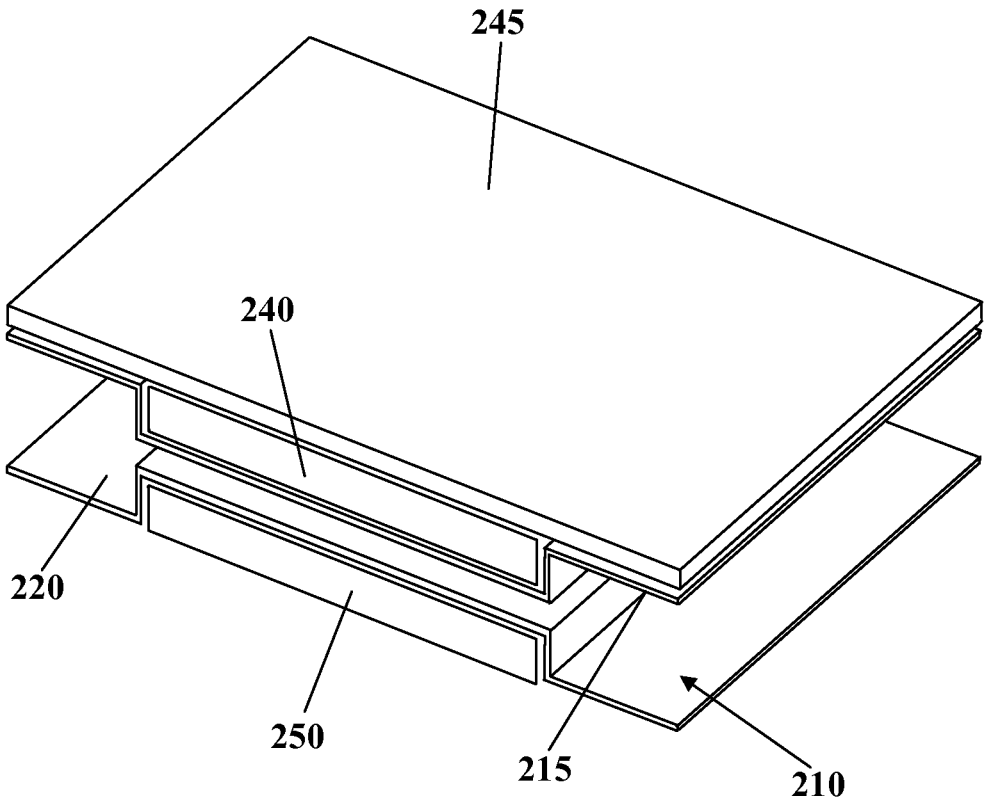
FIG. 2B illustrates a perspective view of the wireless device of FIG. 2A.

FIGS. 2A and 2B illustrate elevation and perspective views, respectively, of a portion of a wireless device 200 comprising a multi-antenna system provided in accordance with an embodiment of the present technology. The wireless device comprises a multi-antenna system 210 comprising a top conductive plate 215, a bottom conductive plate 220, one or more conductive shorts 225 and one or more channels 230 passing through the multi-antenna system 210, including the top plate, bottom plate, and conductive shorts.

As illustrated, the wireless device 200 further comprises a first set of electronic components 240 located on one side of the multi-antenna system 210, and a second set of one or more components 250 located on an opposite side of the multi-antenna system. In one embodiment, the first set of components 240 may comprise a microprocessor, RF electronics, memory, and the like. The second set of components 250 may comprise a battery or other power source. The first set of components 240 and the second set of components 250 are operatively coupled via wires, cables, or the like, passing through the channel 230. The wireless device 200 further comprises a display 245, such as a touch screen display, operatively coupled to the first set of components 240, the second set of components 250, or both. The display 245 may cover a major portion of the top of the wireless device.

The wireless device 200 may further comprise an external housing, which is not shown. For example, the external housing may include a bottom face with a door for battery access, sidewalls with openings to facilitate airflow, and a top housing portion with a cut-out or transparent portion for accessibility to the top display. The external housing may have relatively thin walls, so that the housing is about the same size as the illustrated wireless device 200.

Figure 3:
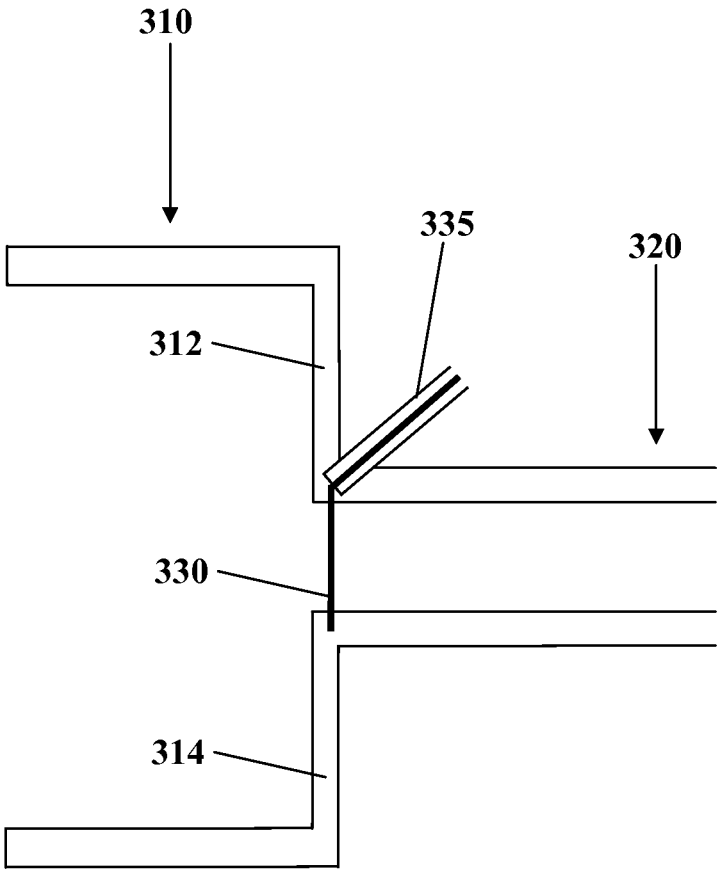
FIG. 3 illustrates an example coupling of a transmission line to an open-slot antenna of a multi-antenna system, in accordance with an embodiment of the present technology.

FIG. 3 illustrates an example coupling of a transmission line to an open-slot antenna 310 of a multi-antenna system, in accordance with an embodiment of the present technology. Another end of the transmission line may be operatively coupled to radio electronics, antenna matching components, and the like. The transmission line comprises a pair of conductors 330 and 335, such as a coaxial cable, pair of conductors of a microstrip or stripline transmission line, or the like. The transmission line is coupled to the antenna 310 substantially at a boundary between the antenna 310 and a resonant cavity 320 coupled thereto. A first conductor 330 of the transmission line is coupled to a first conductive element 314 of the antenna 310, and a second conductor 335 of the transmission line is coupled to a second conductive element 312 of the antenna. The transmission line is thereby coupled at two points of the antenna 310, the two points being across the antenna gap from each other. Channels through at least one conductive plate of the multi-antenna system may be provided to facilitate routing of the transmission line, as would be readily understood by a worker skilled in the art.

While the connection is shown at the center edge of the open part of the resonator it may be beneficial to place the feeds at other locations. These locations may fall either in the slot or resonator cavities and are not necessarily in the center. Such placements may facilitate a broader bandwidth and/or lower frequency operation. In some embodiments, for multi-mode operation, multiple feeds may be provided for individual mutual isolation at different frequencies.

Figure 4:
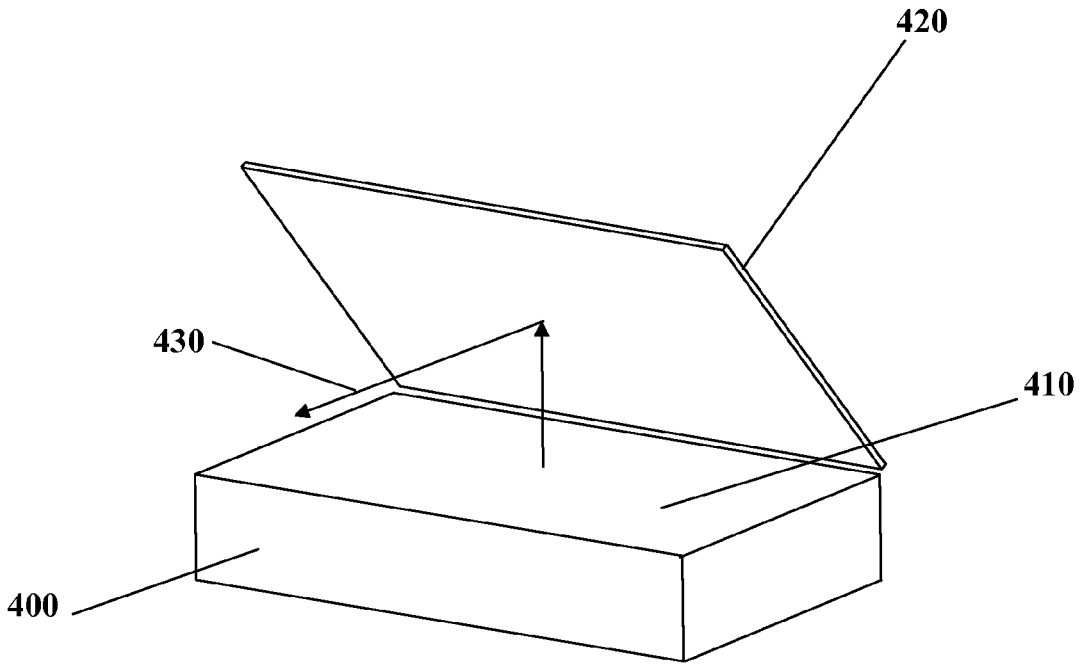
FIG. 4 illustrates a wireless device comprising a multi-antenna system and a multi-orientation display, provided in accordance with an embodiment of the present technology.

FIG. 4 illustrates a wireless device 400 provided in accordance with an embodiment of the present invention. The wireless device internally comprises a multi-antenna system as described elsewhere herein (not shown). The wireless device comprises a display 410 which may cover substantially all of a top surface of the device. The radiation pattern of the multi-antenna system is such that the main regions of radiation do not coincide with the top surface of the device. Thus, the display 410 may cover substantially the entire top surface without interfering with, or being interfered by, operation of the antennas. The wireless device further comprises a reflective, flip-up panel 420 that reflects and redirects images emitted by the display 410. For example, the flip-up panel may be adjustably oriented between a first position and a second position, for example by operation of a hinge along one edge. In the first position, the flip-up panel 420 rests against the display 410. In the second position, the flip-up panel 420 is oriented at an angle, for example of about 45 degrees, from the display 410. The flip-up panel may comprise a material, such as coated or uncoated glass or transparent plastic, which passes incident light which is substantially perpendicular to the panel, while reflecting light which is incident at a range of predetermined angles, such as an angle of less than or equal to 45 degrees. Materials with such optical properties are known in the art, and are employed for example in heads-up displays used in aircraft. Thus, when the flip-up panel is in the first position, the display can be seen through the panel. Further, when the flip-up panel is in the second position, it reflects images from the display toward a viewing position located to the side of the wireless device. Arrows 430 illustrate the image path including reflection.

The wireless device 400 may comprise a panel orientation sensor, such as an electromechanical switch, which detects whether the flip-up panel is in the first position or the second position. When the flip-up panel is detected to be in the second position, the displayed image may be reversed in such a manner that it looks correct as a reflection.

When the flip-up panel 420 is in the second, raised position, the display may be viewed via reflection off of the flip-up panel, rather than having to look directly down at the display 410 from above. Thus, a user may view the display without having to touch or move the device, which might adversely affect wireless communication operations.

It is obvious that the foregoing embodiments of the technology are examples and can be varied in many ways. Such present or future variations are not to be regarded as a departure from the spirit and scope of the technology, and all such modifications as would be obvious to one skilled in the art are intended to be included within the scope of the following claims.

What is claimed is:

1. A multi-antenna system comprising:

a.) a first open-slot antenna comprising first and second conductive elements defining a first region between opposing faces thereof;

b.) a second open-slot antenna comprising third and fourth conductive elements defining a second region between opposing faces thereof;

c.) a first resonant cavity operatively coupled to the first open-slot antenna and disposed between the first open-slot antenna and the second open-slot antenna, the first resonant cavity comprising fifth and sixth conductive elements defining a third region between opposing faces thereof, the third region connected with the first region;

d.) a second resonant cavity operatively coupled to the second open-slot antenna and disposed between the first open-slot antenna and the second open-slot antenna, the second resonant cavity comprising seventh and eighth conductive elements defining a fourth region between opposing faces thereof, the fourth region in communication with the second region; and e.) one or more conductive shorts, each of the one or more conductive shorts configured to electrically couple the fifth conductive element to the sixth conductive element, and to electrically couple the seventh conductive element to the eighth conductive element.

2. The multi-antenna system according to claim 1, wherein the first conductive element, the third conductive element, the fifth conductive element and the seventh conductive element are integral to a first substantially contiguous conductive plate, and the second conductive element, the fourth conductive element, the sixth conductive element, and the eighth conductive element are integral to a second substantially contiguous conductive plate.

3. The multi-antenna system according to claim 2, wherein a channel is formed passing through the first conductive plate, the second conductive plate, and an interior portion of one of the conductive shorts.

4. The multi-antenna system according to claim 2, wherein each of the first open-slot antenna and the second open-slot antenna have a substantially linear polarization which is substantially perpendicular to the first conductive plate.

5. The multi-antenna system according to claim 2, wherein outside surfaces of the first conductive plate and the second conductive plate are substantially electrically neutral during antenna operation, thereby limiting currents present on said outside surfaces.

6. The multi-antenna system according to claim 1, wherein each of the first, second, third, fourth, fifth, sixth, seventh and eighth conductive elements have predetermined thicknesses, said faces of each of the first, second, third, fourth, fifth, sixth, seventh and eighth conductive elements have predetermined lengths and widths, and wherein each of said thicknesses is less than each of said lengths and widths.

7. The multi-antenna system according to claim 1, wherein the first and second conductive elements are separated by a first predetermined distance, and the fifth and sixth conductive elements are separated by a second predetermined distance less than the first predetermined distance.

8. The multi-antenna system according to claim 1, wherein the one or more conductive shorts comprise plural, spaced-apart conductive shorts.

9. The multi-antenna system according to claim 1, wherein the conductive shorts provide for a continuous ground plane between the first open-slot antenna and the second open-slot antenna.

10. The multi-antenna system according to claim 1, wherein the first open-slot antenna and the second open-slot antenna are substantially isolated from one another.

11. The multi-antenna system according to claim 1, wherein the conductive shorts provide for a high front to back ratio for each of the first open-slot antenna and the second open-slot antenna, thereby facilitating isolation of the first open-slot antenna and the second open-slot antenna.

12. The multi-antenna system according to claim 1, further comprising additional shorting posts, tuning posts, or both, placed between one or more of: the first and second conductive elements; the third and fourth conductive elements; the fifth and sixth conductive elements; and the seventh and eighth conductive elements.

13. A wireless device comprising the multi-antenna system according to claim 1.

14. The wireless device according to claim 13, wherein the first conductive element, the third conductive element, the fifth conductive element and the seventh conductive element are integral to a first substantially contiguous conductive plate, and the second conductive element, the fourth conductive element, the sixth conductive element, and the eighth conductive element are integral to a second substantially contiguous conductive plate.

15. The wireless device according to claim 14, wherein the wireless device comprises a first set of components and a second set of components, the multi-antenna system disposed between the first set of components and the second set of components, wherein the multi-antenna system comprises a channel passing through the first conductive plate, the second conductive plate, and an interior portion of one of the conductive shorts, and wherein the first set of components and the second set of components are operatively coupled via the channel.

16. The wireless device according to claim 15, wherein the first set of components and is at least partially located within a pocket formed within the first conductive plate.

17. The wireless device according to claim 15, wherein the open gap is exposed to an exterior of the wireless device.

18. The wireless device according to claim 14, wherein a length of the first conductive plate is about equal to a corresponding length of the mobile device, and a width of the first conductive plate is about equal to a corresponding width of the mobile device.

19. The wireless device according to claim 13, further comprising an open gap associated with one or both of the first open-slot antenna and the second open-slot antenna, the open gap facilitating heat isolation, convective cooling, or both.

20. The wireless device according to claim 13, further comprising a display substantially covering an entire upper surface of the wireless device.

21. A multi-antenna system comprising first and second spaced-apart conductive plates configured to define:

a.) a first open-slot antenna;

b.) a second open-slot antenna;

c.) a first resonant cavity adjacent and operatively coupled to the first open-slot antenna and disposed between the first open-slot antenna and the second open-slot antenna; and d.) a second resonant cavity adjacent and operatively coupled to the second open-slot antenna and disposed between the first resonant cavity and the second open-slot antenna;

the multi-antenna system further comprising one or more conductive shorts configured to electrically couple the first conductive plate to the second conductive plate, the one or more conductive shorts located along a boundary between the first resonant cavity and the second resonant cavity.

22. The multi-antenna system according to claim 21, wherein the first open-slot antenna comprises first and second conductive elements defining a region between opposing faces thereof, the region comprising at least one non-conductive face, the first conductive element formed of a portion of the first conductive plate, the second conductive element formed of a portion of the second conductive plate.

* * * * *